US006321897B1

(12) United States Patent
Cassoni et al.

(10) Patent No.: US 6,321,897 B1
(45) Date of Patent: Nov. 27, 2001

(54) RECYCLABLE POCKET SYSTEM FOR PRINTED PRODUCTS

(75) Inventors: Robert Paul Cassoni, Centerville; John Lawrence Herman, Huber Heights, both of OH (US)

(73) Assignee: Heidelberger Druckmaschinen, AG, Heidelberg (DE)

( * ) Notice: Subject to any disclaimer, the term of this patent is extended or adjusted under 35 U.S.C. 154(b) by 0 days.

(21) Appl. No.: 09/448,990

(22) Filed: Nov. 24, 1999

(51) Int. Cl.[7] ..... B65G 29/00

(52) U.S. Cl. ..... 198/465.1; 198/867.14; 198/867.15; 198/867.05

(58) Field of Search ..... 198/867.14, 465.4, 198/465.1, 867.15, 867.05, 687.1

(56) References Cited

U.S. PATENT DOCUMENTS 3,530,970 * 9/1970 Richardson et al. ..... 198/20
3,702,129 11/1972 Hawkes et al. ..... 198/803.07
4,068,756 * 1/1978 Loewenthal ..... 198/653
4,073,236 * 2/1978 Harrington ..... 104/172
5,261,520 * 11/1993 Duke ..... 198/375
6,021,725 * 2/2000 Resta ..... 112/117

* cited by examiner

*Primary Examiner*—Christopher P. Ellis
*Assistant Examiner*—Joe Dillon, Jr.
(74) *Attorney, Agent, or Firm*—Davidson, Davidson & Kappel, LLC

(57) ABSTRACT

A device for transporting printed products including a plurality of individual pocket grippers, each pocket gripper having a first connector on one side and a second connector on a second side, and having gripping elements for gripping a printed product. A plurality of transport units is also provided, with each transport unit being movable along a track and being releasably attached to the first connector of a respective one of the plurality of pocket grippers. Also disclosed is a method for transporting printed products including the steps of gripping a printed product in a gripper pocket, moving the gripper pocket along a track, and releasing the gripper pocket while the printed product remains gripped.

8 Claims, 8 Drawing Sheets

RECYCLABLE POCKET SYSTEM FOR PRINTED PRODUCTS

BACKGROUND OF THE INVENTION

1. Field of the Invention

The present invention relates generally to printing presses and more particularly to a device and method for transporting printed products.

2. Background Information

Web printing presses print a continuous web of material, such as paper. The continuous web then is cut in a cutting unit so as to form book blocks. These book blocks can be sections of a newspaper, for example. In order to transport or process the book blocks, for example to perform a trimming operation, it is often desirable to firmly grip the book in a book clamp which is moveable along a track.

U.S. Pat. No. 3,702,129 purports to describe a mechanical book clamp which can accommodate various book thicknesses. A chain drive can be used to move individual clamps along a desired path. The books are gripped from above between an inner clamp plate and a pivotal outer book plate, which is actuated by an actuating means.

The device of this patent has the disadvantage that the book clamps require a complicated actuating mechanism and that entire book clamp is fixed to the chain drive. Thus, if the book is to be transferred to a path different from the chain drive path, the signature must be fully released and transferred to a separate device. During this transfer, the book block can be damaged. For example, dog-earring may occur during such transfers.

BRIEF SUMMARY OF THE INVENTION

An object of the present invention is to provide for a device and method for gripping and transporting printed products whereby damage to the printed products may be reduced. An additional or alternative object of the present invention is to provide for adequate gripping of the printed products.

The present invention provides a device for transporting printed products including a plurality of individual pocket grippers, each pocket gripper having a first connector on one side and a second connector on a second side, and having gripping elements for gripping a printed product. These gripping elements may include a front plate and a rear plate, with the printed product gripped between the front and rear plate. A plurality of transport units is also provided, with each transport unit being movable along a track and being releasably attached to the first connector of a respective one of the plurality of pocket grippers.

The connectors of the pocket grippers are preferably bars, one of which is gripped by the transport unit, so that the pocket grippers may be moved along a track. The transport unit thus preferably has a jaw set for firmly grasping one of the bars.

As the products are to be transmitted along the track, the second connector is free and not grasped by a transport unit. When the products are to be changed to a different track, the second connector can be grasped by transport units traveling along the second track. The first connector is then released, and then the product travel along the second track. Thus the product does not need to be re-gripped upon a path change, thus eliminating or reducing the potential for damage to the product.

Moreover, the product may remain gripped in the pocket grippers while passing through various work stations, which also reduces the need for re-gripping of products. The fact that the product is firmly gripped between two plates also helps prevent fluff from entering between sheets of the product. Moreover, the use of the pocket grippers permits a same transfer point on the pocket grippers to be used to transfer the products, independent of product size or shape. This same grip point provides versatility in transport of products, in that both big phone books or small leaflets can have the same transfer point on a pocket gripper, for example.

The present invention also provides a method for transporting printed products including the steps of gripping a printed product in a gripper pocket, moving the gripper pocket along a track, and releasing the gripper pocket while the printed product remains gripped.

The method further includes grasping the released gripper pocket and moving the released gripper pocket along a second track.

BRIEF DESCRIPTION OF THE DRAWINGS

An embodiment of the present invention is described below by reference to the following drawings, in which.

DETAILED DESCRIPTION

Figure 1:
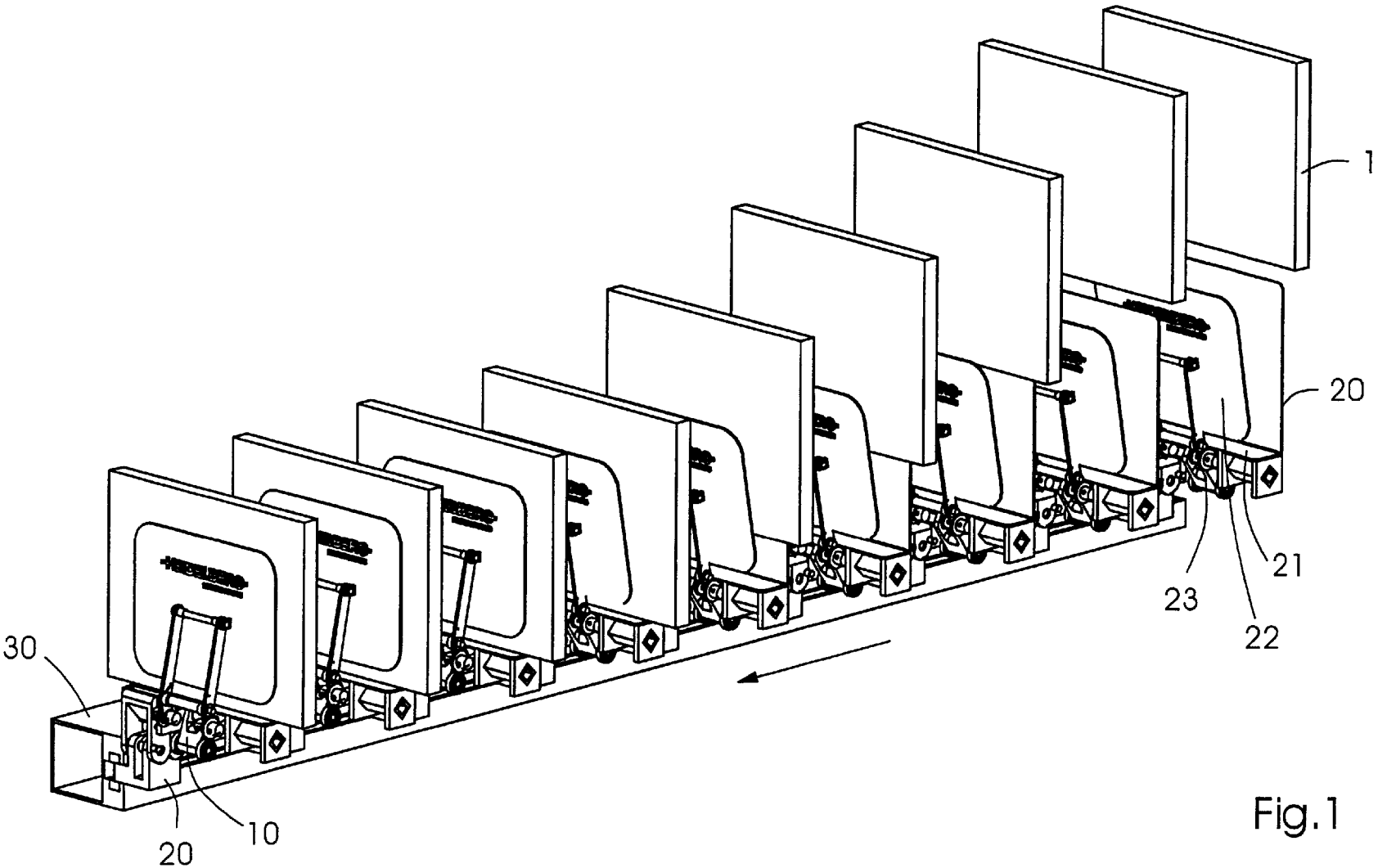
FIG. 1 shows a top perspective view of a plurality of gripper pockets and transport units moving along a track.
Figure 2:
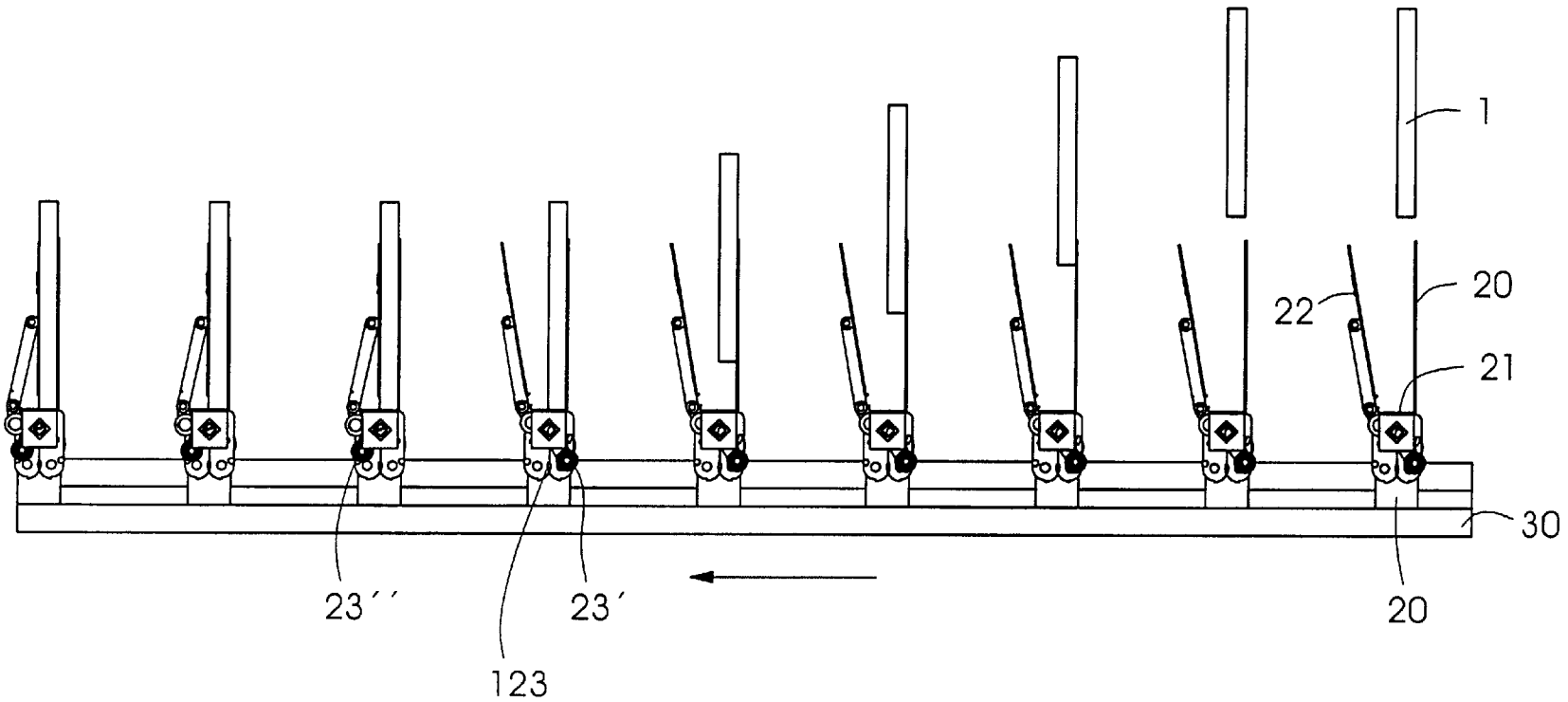
FIG. 2 shows a side view of FIG. 1.

FIGS. 1 and 2 show a top perspective view and a side view of an embodiment of the present invention. A plurality of gripper pockets 10 are grasped by respective transport units 20. Transport units 20 move within an endless track 30, which may have a belt or chain drive for moving the transport units. Transport units 20 are not detachable from track 30. However, gripper pockets 10 are detachable from transport units 20.

Each gripper pocket 10 has a rear plate 20 fixed to a base 21 and a retractable face plate 22. Face plate 22 is spring loaded so as to move toward rear plate 20. A cam or roller arrangement 23 can be pressed so as to act against the spring force and open face plate 22, i.e. move face plate 22 away from fixed rear plate 20. Thus an actuating track can be placed under the gripper pockets next to track 30 to press against the roller arrangement 23, so that the gripper pockets 10 are open to receive printed products 1. When the actuating track ends, the pressure on roller arrangement 23 is relieved and the gripper pockets 10 close to grip the product.

Figure 3:
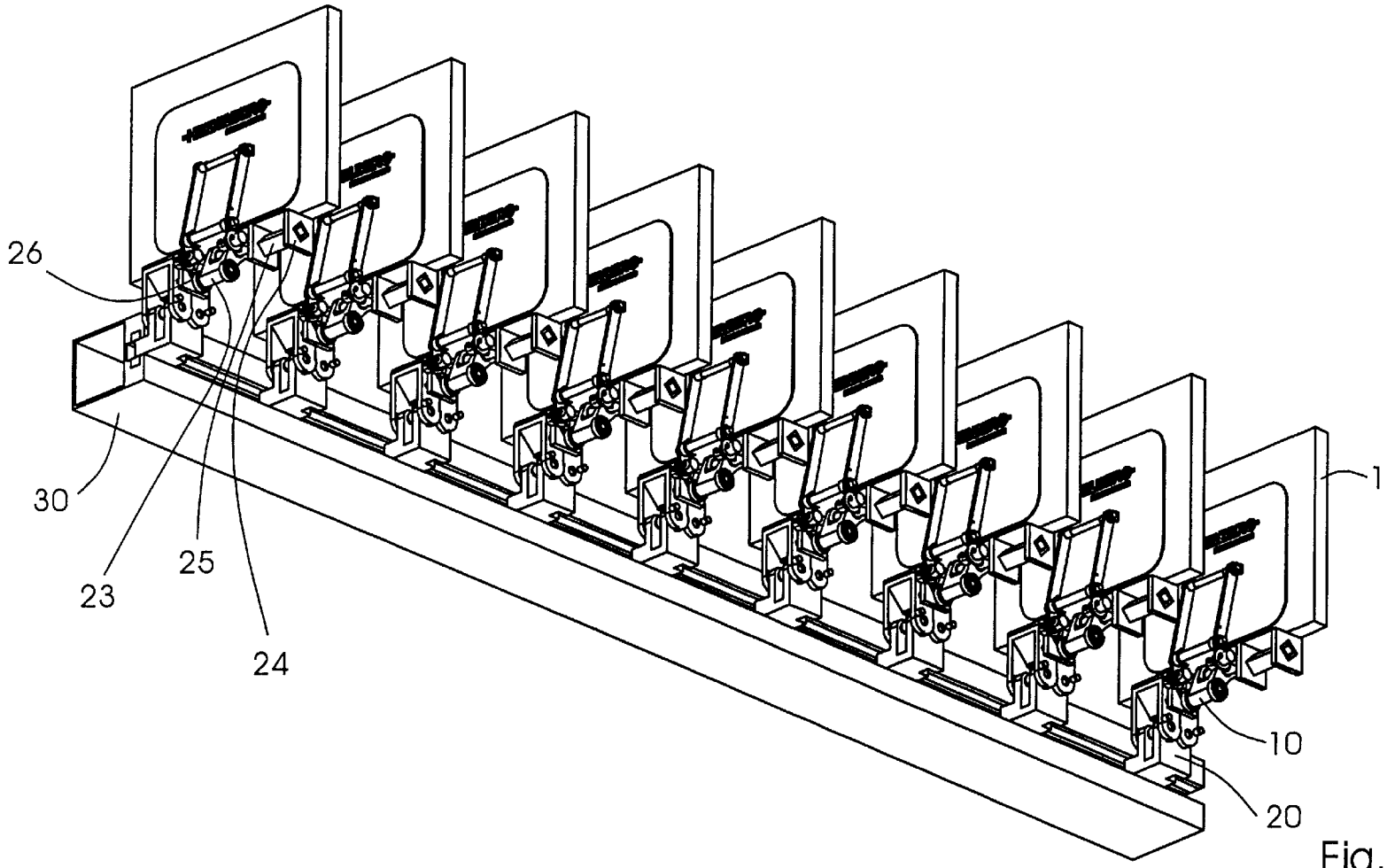
FIG. 3 shows a bottom perspective view of the gripper pockets and transport units moving along a track.

FIG. 3 shows a bottom perspective view of a plurality of gripper pockets 10 being transported along track 30 by individual transport units 20. At the bottom of each gripper pocket is roller arrangement 23, which can actuate the gripper pocket to open. Also at the bottom of each gripper pocket is a connector 24 at one side. Connector 24 includes two side plates and a four-sided bar 25. Each gripper pocket also has a second connector 26 opposite first connector 24. Second connector 26 also has a four-sided bar between two side plates and is shown in FIG. 3 being grasped by a transport unit 20.

Figure 4:
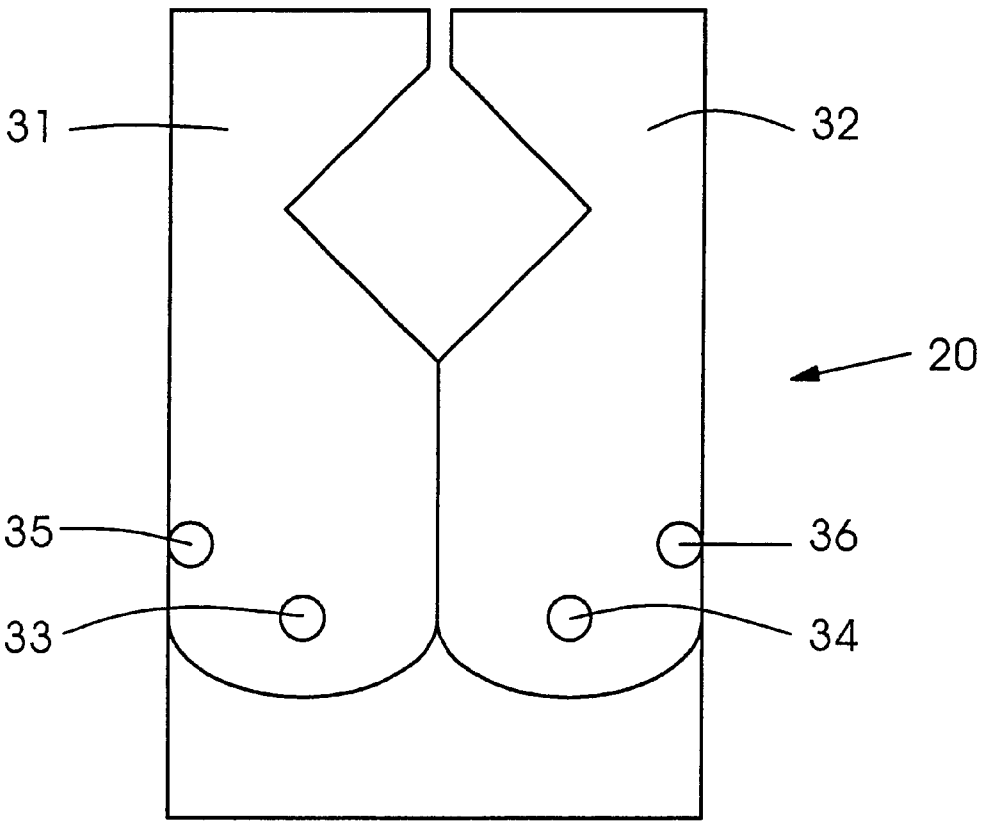
FIG. 4 shows a side view of a transport unit.

As shown in FIG. 4, each transport unit 20 has a first jaw 31 and a second jaw 32, which are rotatable about an axis 33 and an axis 34, respectively. Springs are provided about the axes 33 and 34 so that jaws 31 and 32 are forced together, i.e. that jaw 31 is forced in a clockwise direction about axis 33 and jaw 32 is forced in a counterclockwise direction about axis 34. Actuating knobs 35 and 36 are provided so that a jaw opening device may force the knobs apart so as to open the jaws 31 and 32. The jaws 31 and 32 of each transport unit thus may grasp a bar of a connector 24 or 26 of a gripper pocket 10 to transport the gripper pocket along a track.

Figure 5:
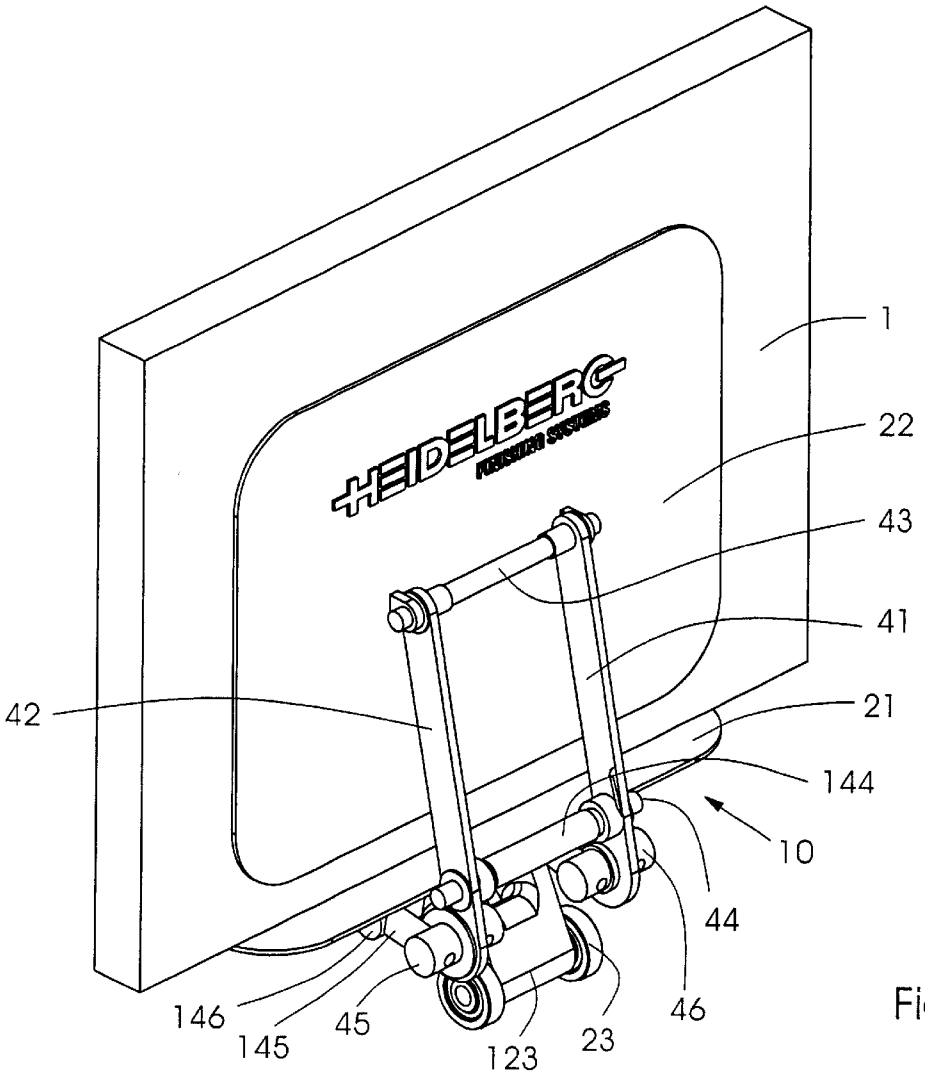
FIG. 5 shows details of a part of a gripper pocket.

FIG. 5 shows a gripper pocket 10 for holding a book block 1. For clarity purposes only, the connectors 24 and 26 are not shown in FIG. 5. Gripper pocket 10 includes face plate 22 which is connected to two arms 41 and 42, which are in turn supported by two pins 43 and 44. Pin 44 is supported rotatably in a pin housing 144 which is fixed to base 21. Arms 41 and 42 are rotatable about pin 44, and are connected at a bottom end to pins 45 and 46, respectively. Pin 45 is connected by spring 145 to a shaft 146. A spring is also provided between pin 46 and shaft 146. Shaft 146 is attached to a roller support 123, which has rollers 23 at one end 22 and is attached pivotably about base 21 at the other end. Thus, as shown in FIG. 2, rollers 23 can move from a position 23' where the face plate 22 is open, to a position 23", where the face plate 22 is closed and grips the printed product 1. This change can be effected by a cam follower which moves the rollers into the position 23", where they may be locked over center, i.e. the face plate remains shut until the rollers are moved by a cam back to the open face plate position.

Support 123 thus rotates about base 21 to move shaft 146 toward face plate 22. This movement forces springs 145 to force pins 45 and 46 to rotate arms 41 and 42 about pin 44, thereby closing face plate 22 and gripping product 1.

Figure 6:
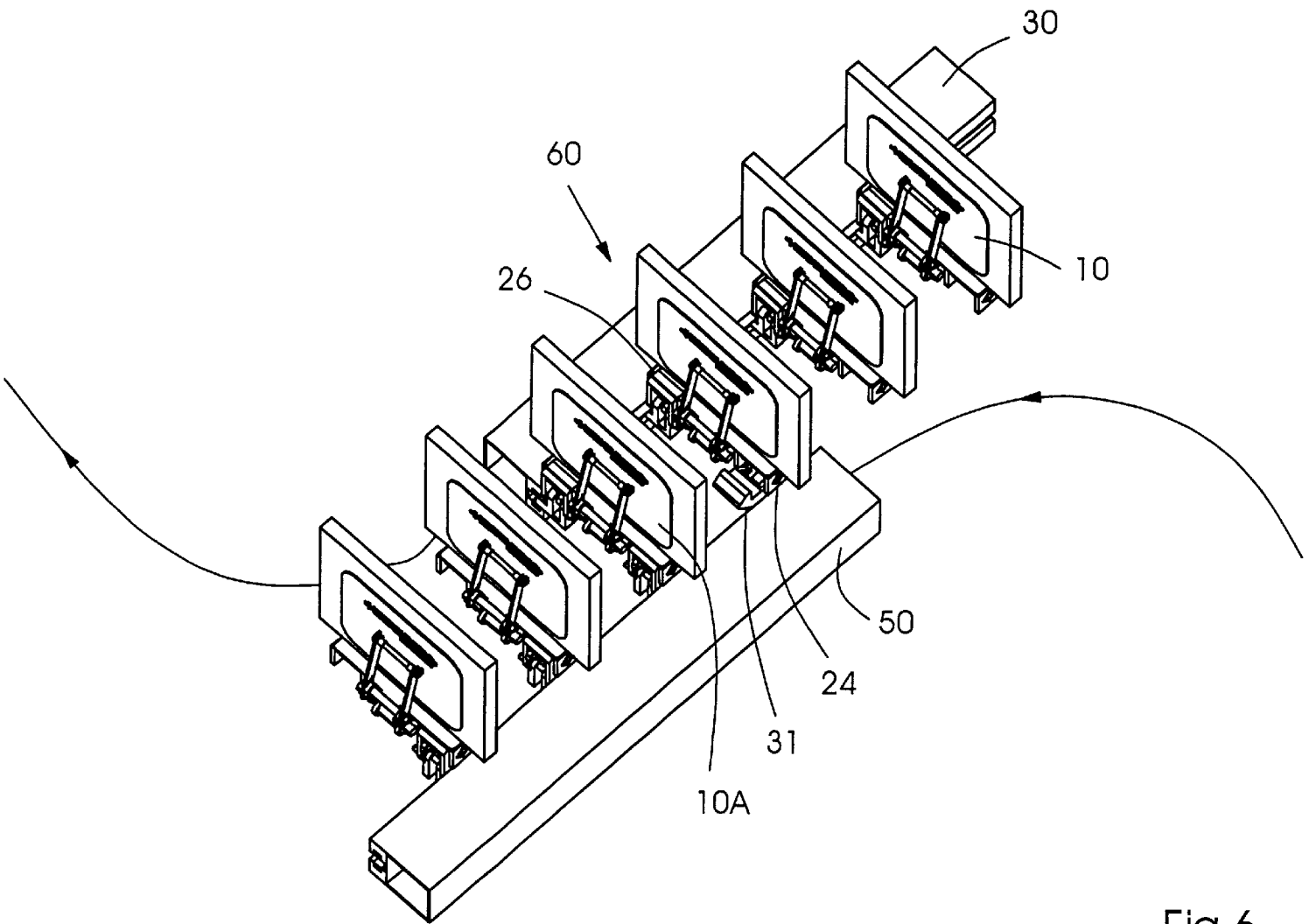
FIG. 6 shows a top perspective view of gripper pockets being transferred between two tracks.
Figure 7:
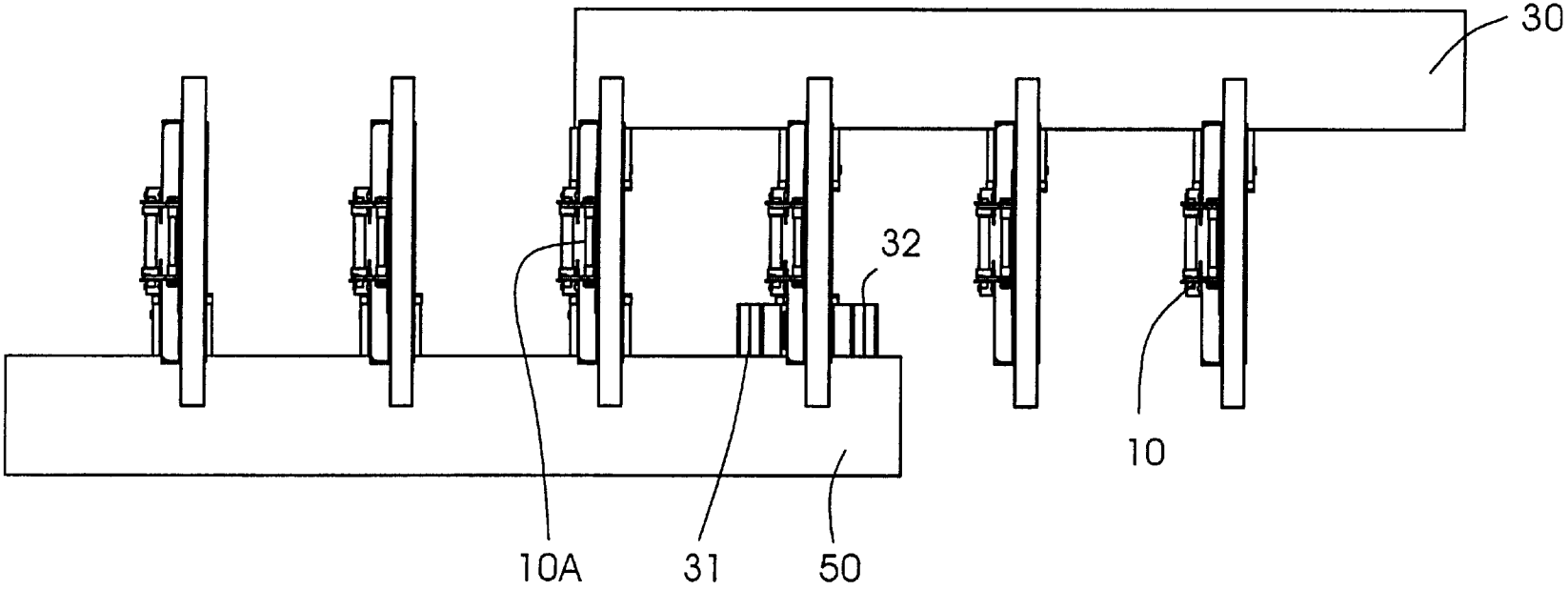
FIG. 7 shows a top view of FIG. 6.

FIGS. 6 and 7 shows a plurality of gripper pockets 10 being transferred from a first track 30 to a second track 50. Jaws of individual transport units in track 50 open as the transport units enter transfer area 60. As shown in FIGS. 6 and 7, jaws 31 and 32 of one of the transport units are open and about to grip a connector 24. The other connector 26 remains gripped by a transport unit in track 30. The next gripper pocket 10A is thus temporarily gripped on both its first and second connectors by transport units in both tracks 30 and 50. The jaws for the transport unit in track 30 are then released so that gripper pockets 10 are traveling solely along track 50.

Thus the transfer of printed products can proceed from one track to another track without the printed products being released and re-gripped. This arrangement advantageously protects the printed products during such transfers.

Figure 8:
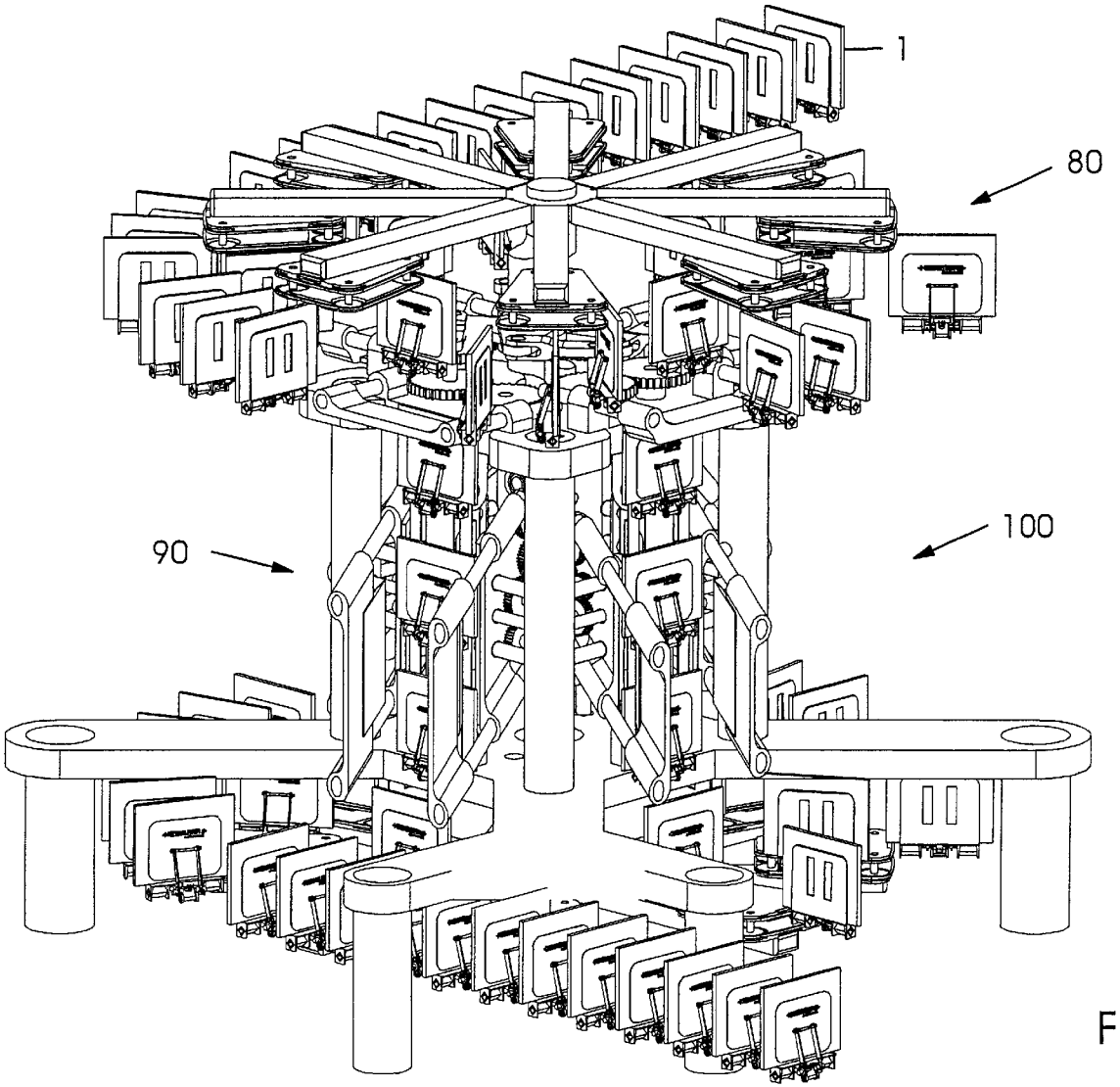
FIG. 8 shows a top perspective view of individual gripper pockets moving through a splitting and processing unit.

FIG. 8 shows a schematic overview of how the gripper pockets of the present invention may be transferred through a processing station 100 having a stream splitter 80 and a plurality of processing units, such as trimmers 90. Tracks and transfer devices are omitted in part for clarity. However, it can be understood that the entire travel of the printed products 1 through the processing device can occur without the release or re-gripping of the printed products. The details of the processing station and stream splitter are disclosed, for example, in co-pending U.S. patent application Ser. Nos. 09/449,127, 09/448,986, and 09/449,133 entitled "High Speed Processing Device for Printed Products," "Device and Method for Trimming Printed Products," and "Device and Method for Splitting A Printed Product Stream," respectively. These applications are filed on even date herewith and have the same inventors as the present application. All three applications are also hereby incorporated by reference herein.

What is claimed is:

1. A device for transporting printed products comprising:

a plurality of individual pocket grippers, each pocket gripper having a first connector on one side and a second connector on a second side, and each pocket gripper having gripping elements for gripping a printed product, and a plurality of transport units, each transport unit being movable along a track in a direction of conveyance and being releasably attachable to either the first connector or the second connector of a respective one of the plurality of pocket grippers.

2. The device as recited in claim 1 wherein each pocket gripper includes a device for moving the front plate and the rear plate apart.

3. The device as recited in claim 1 further comprising a second plurality of gripper units being moveable along a second track and being releasably attached to the second connector of a respective one of the plurality of pocket grippers.

4. The device as recited in claim 1 wherein the gripper elements include a front plate and a rear plate.

5. The device as recited in claim 1 wherein the first connector includes a bar.

6. The device as recited in claim 5 wherein each transport unit includes a pair of jaws for grasping the bar.

7. The device as recited in claim 1 wherein each transport unit includes a pair of jaws.

8. The device as recited in claim 6 wherein the jaws are spring-loaded together.

* * * * *